United States Patent [19]

Edmunds

[11] 4,370,873

[45] Feb. 1, 1983

[54] LATCH MECHANISM AND VANDAL RESISTANT HOUSING

[76] Inventor: Gregory A. Edmunds, 3011 Brinkley Rd., Temple Hills, Md. 20031

[21] Appl. No.: 125,444

[22] Filed: Feb. 28, 1980

[51] Int. Cl.[3] ..... E05B 15/00; E05B 63/00; E05B 65/08; G07F 17/20

[52] U.S. Cl. ..... 70/163; 70/169; 70/173; 70/371; 70/416; 70/418; 70/419; 70/167; 194/1 A; 232/15; 292/229

[58] Field of Search ..... 70/371, 417, 416, 167–169, 70/171–173, 63, 100, 158–163, 81, 86, 423, DIG. 56, 57, 14, 19, 58, 164, 77, 78, 232; 194/1 A, 1 B; 232/15, 43.2; 292/229, 197, 129, 108, 98, 106, 208, 207, 104

[56] References Cited

U.S. PATENT DOCUMENTS

| | | | |
|---|---|---|---|
| 199,916 | 2/1878 | Lozier | 292/197 |
| 424,454 | 4/1890 | Biery | 292/229 |
| 1,076,616 | 10/1913 | Tyden | 292/104 X |
| 1,178,920 | 4/1916 | Hawley | 70/371 X |
| 1,369,886 | 3/1921 | Dement | 70/19 X |
| 1,381,215 | 6/1921 | Murphy | 292/208 X |
| 1,382,577 | 6/1921 | Vauclain et al. | 70/172 X |
| 1,955,462 | 4/1934 | Kaufman | 70/57 |
| 2,073,109 | 3/1937 | Kirkwood | 70/371 X |
| 2,291,217 | 7/1942 | Hoecker | 70/371 X |
| 2,685,002 | 7/1954 | Reilly | 70/371 X |
| 3,204,438 | 9/1965 | Sollenberger | 70/417 |
| 3,213,210 | 10/1965 | Samples | 70/168 X |
| 3,296,842 | 1/1967 | Auerbach et al. | 70/371 X |
| 3,391,256 | 7/1968 | Nawman | 70/162 X |
| 3,410,580 | 11/1968 | Longenecker | 70/58 X |
| 3,720,083 | 3/1973 | Wellekens | 70/371 X |
| 3,780,546 | 12/1973 | Longenecker | 70/58 |
| 3,807,627 | 4/1974 | Nitschneider | 232/15 |
| 3,902,340 | 9/1975 | Leyden | 70/57 |
| 4,038,844 | 8/1977 | Carlson | 70/423 X |
| 4,051,790 | 10/1977 | Meditz et al. | 70/63 X |
| 4,102,161 | 7/1978 | Proefrock | 70/416 X |

FOREIGN PATENT DOCUMENTS

| | | | |
|---|---|---|---|
| 931931 | 8/1955 | Fed. Rep. of Germany | 292/197 |
| 1292033 | 4/1969 | Fed. Rep. of Germany | 70/63 |
| 374614 | 6/1932 | United Kingdom | 70/371 |
| 594693 | 11/1947 | United Kingdom | 70/416 |

*Primary Examiner*—Cornelius J. Husar
*Assistant Examiner*—Carl F. Pietruszka
*Attorney, Agent, or Firm*—Charles A. Brown

[57] ABSTRACT

A protective housing and latch mechanism for securing the protective housing in a position protecting the customary housing for a coin mechanism and coin box. The protective housing permits normal operation of the coin mechanism and is of sufficient strength to resist deformation by sledge hammer blows. The protective housing carries a latch mechanism which locks the protective housing to the original housing for the coin mechanism so as to prevent separation of the two housings. The latch mechanism includes a pivotally mounted latch member which is urged to a latching position and held in that position by a barrel type lock which is disposed in an inaccessible position within a hardened block.

5 Claims, 7 Drawing Figures

LATCH MECHANISM AND VANDAL RESISTANT HOUSING

This invention relates in general to new and useful improvements in a latch mechanism, and more particularly to means for protecting against vandalism coil actuated mechanism and coin boxes of vending machines, particularly commercial washers.

Commercial washers are customarily built with a housing securely fastened to the top wall thereof with the housing having therein the coin mechanism and coin box. While in recent years, the housings have been made of heavier gauge steel, substantially all such housings are not of sufficient strength to withstand battering with tools, such as sledge hammers. Accordingly, it is the common practice of vandals to find an isolated commercial washer and to strike the housing for the coin mechanism and coin box several hard blows with a sledge hammer, with the result that the housing will rupture or break loose from the washer and the contents of the coin box become readily available.

In accordance with this invention, it is proposed to provide a protective housing which may be dropped over the conventional housing for the coin actuated mechanism and coin box of, for example, a commercial washer, with this protective housing being of a size and shape to completely protect the coin mechanism and coin box, except at the rear where the appliance normally is held against the wall and access is not available. This protective housing is secured on the original housing by means of a latch mechanism.

The aforementioned latch mechanism is a principal component of this invention. The latch mechanism is in the form of a solid block of metal, preferably hardened steel, which is mounted on one face of the protective housing and preferably within an opening formed therein. The block is welded to the protective housing.

The solid block of the latch mechanism includes a latching face which opens into the interior of the protective housing and this latching face has a slot formed therein. A latch member is pivotally mounted within the slot and is pivotable out through the slot for the purpose of engaging within an opening formed in a wall of the conventional housing for the coin mechanism and coin box.

The latch mechanism block also has a lower end which normally faces the top wall of the appliance and this end has a bore or opening therethrough which extends into the slot for receiving a barrel type, key actuated lock. When the lock is positioned within the bore, it cams the latch member to its projecting latching position. A principal feature of this arrangement is that access to the lock is greatly restricted by the proximity of the top of the appliance and the latch mechanism can be released only by the removal of the lock, not the driving of the lock into the block.

The latch member is spring-loaded towards a retracted position so that it is automatically released when the lock is removed.

All exposed surfaces of the block which can be effectively hit in a direction to effect removal of the block are sloping relative to that surface of the housing on which the block is mounted so as to cause a striking object to glance therefrom when the block is hit in a direction which could possibly facilitate the removal thereof.

A further principal feature of the invention is that the protective housing may be applied to existing housings for coin actuated mechanisms and coin boxes by simply machining a small slot in one wall of the customary housing.

With the above, and other objects in view that will hereinafter appear, the nature of the invention will be more clearly understood by reference to the following detailed description, the appended claims and the several views illustrated in the accompanying drawing.

Figure 1:
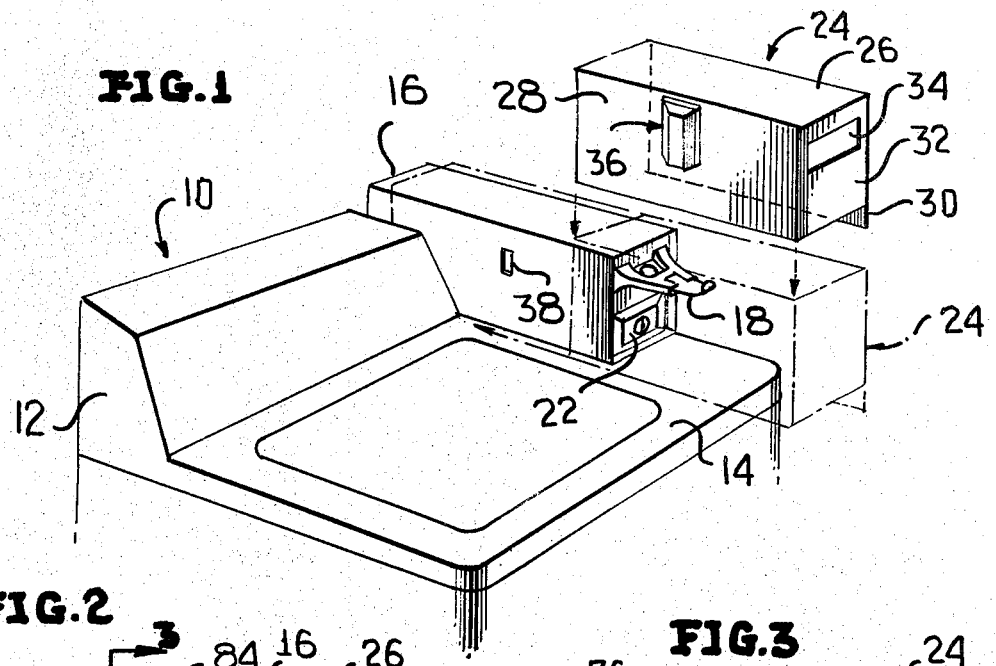
FIG. 1 is an exploded perspective view showing an upper portion of a conventional commercial washing machine with a coin mechanism, and the protective housing and latch mechanism positioned for encasement of the coin mechanism and coin box.

Referring now the drawings in detail, it will be seen that there is illustrated in FIG. 1 a commercial washer, generally identified by the numeral 10, which is of the coin actuated type. The washer 10 includes a top unit 12 defining a top wall 14. The top wall 14 has rigidly secured thereto a housing 16 in which there is housed the usual coin mechanism of which a combined coin receiver and actuator 18 is shown projecting from the front thereof in the normal manner. Within the housing 16 is a coin box 20 (FIG. 2) to which access is obtained through a latched panel 22.

The aforedescribed commercial washer 10 and like appliances may have adequate protection against theft of the coins by children and petty thieves. However, experience has shown that access to the coin box 20 may be readily had by striking the housing 16 several heavy blows with instruments, such as sledge hammers. This mode of gaining access to the coin box is increasing at a very rapid rate and it is becoming a very costly factor in commercial washing machines and the like.

In accordance with this invention, it is proposed to generally house the housing 16 in a protective housing 24. The protective housing 24 includes a top wall 26, an inner side wall 28, an outer side wall 30 and a front wall 32. The protective housing 24 is formed of very heavy gauge sheetmetal and may be further reinforced as deemed necessary.

The housing 24 is opened at the back and at the bottom. Further, the front wall has an opening 34 therein. As is clearly shown in phantom lines in FIG. 1, the protective housing 24 is engaged over the housing 16 by merely dropping the protective housing 24 down over the front part of the housing 16 and then forcing the same rearwardly. The actuator 18 passes through the opening 34 and the coin mechanism is operated in the conventional manner.

It will be readily apparent that the protective housing 24 will completely protect the housing 16 from any vandal utilizing a sledge hammer or like implement. However, the problem next to be solved is how to retain the protective housing 24 on the housing 16. This has been solved by providing a latch mechanism, generally identified by the numeral 36, on the inner side wall 28 and a slot 38 through the inner side wall of the housing 16, as is shown in FIG. 1.

Figure 4:
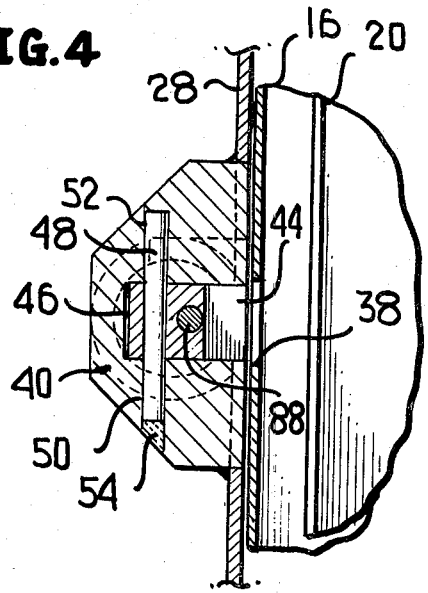
FIG. 4 is a transverse horizontal sectional view taken generally along the line 4—4 of FIG. 2 and shows further the mounting of the latch member.
Figure 5:
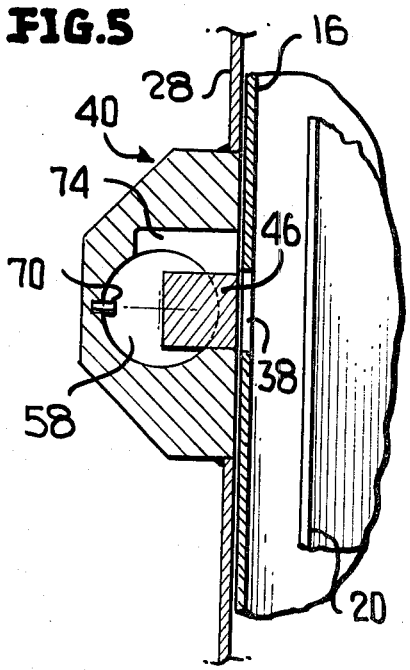
FIG. 5 is a transverse horizontal sectional view taken generally along the line 5—5 of FIG. 2 and shows the interior of the block for receiving the lock.

The latch mechanism 36 includes a solid block of hardened steel, the block being generally identified by the numeral 40. The block 40 has an inner or latching face 42 into which there is a machined a vertically extending slot 44. The slot 44 has mounted therein a pivotally mounted latch member 46. The latch member 46 is mounted on a pivot pin 48 which extends transversely of the slot 40 and has the ends thereof journalled in bores in the block 40, as is best shown in FIG. 4. With reference to FIG. 4, it will be seen that starting in one of the vertical side walls of the block 40 a bore 50 is formed. As the drilling continues, a second and aligned bore 52 is formed on the opposite side of the slot 44. The pivot pin 48 is inserted into the bores 50, 52 through the opened end of the bore 50, after which the opened end of the bore 50 is closed by welding 54. Further, with subsequent machining, it becomes extremely difficult to even locate the weld metal 54.

The block 40 is mounted with the slot 44 vertically disposed and thus has a lower end 56. An opening or bore 58 is formed in the block through the lower end 56 with the bore 58 extending into the bottom part of the slot 44.

Figure 7:
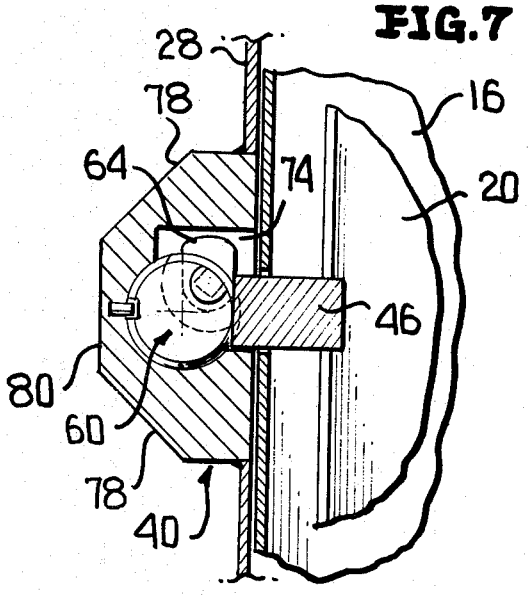
FIG. 7 is a transverse horizontal sectional view similar to FIG. 5 but taken along the line 7—7 of FIG. 6.

A conventional barrel type lock, generally identified by the numeral 60 is receivable within the bore 58. The lock 60 includes a barrel type housing 62, a key actuated tumbler mechanism (not shown), and a retaining element 64, as is best shown in FIG. 7.

Figure 2:
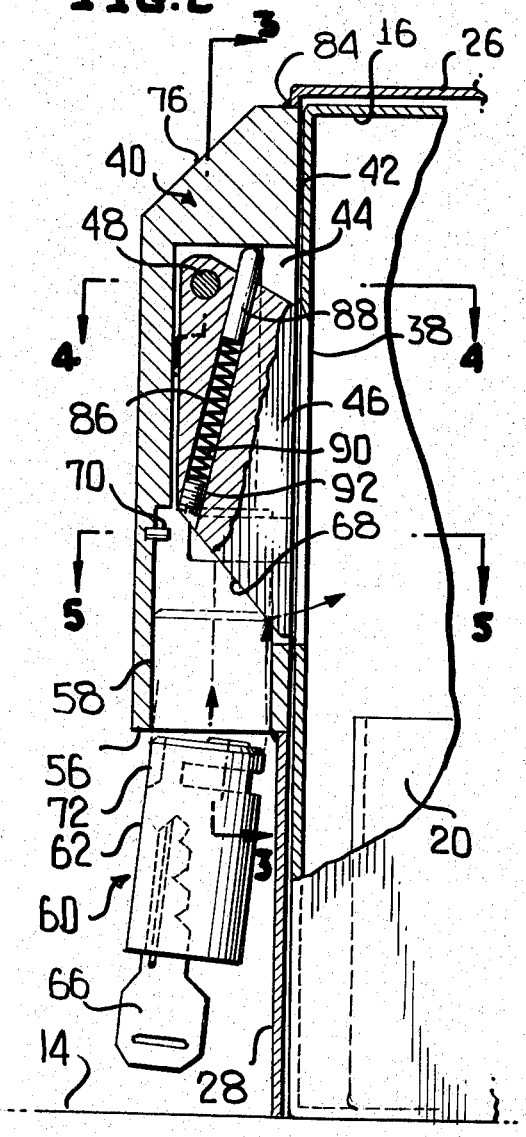
FIG. 2 is a fragmentary enlarged transverse vertical sectional view showing the protective housing in place and the lock being positioned within the block of the latch mechanism.
Figure 3:
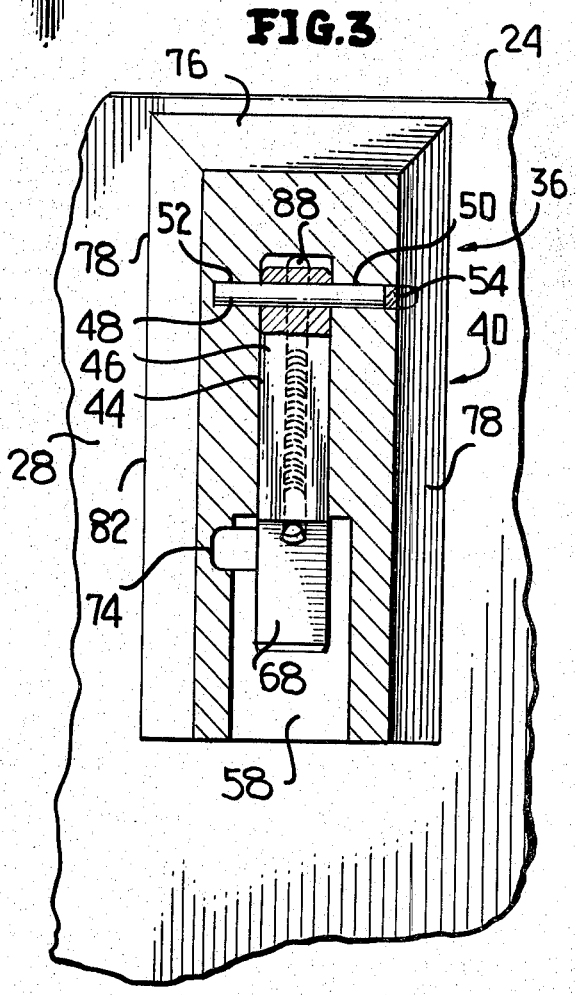
FIG. 3 is a fragmentary vertical sectional view taken generally along the line 3—3 of FIG. 2 and shows more specifically the mounting of the latch member and the openings formed in the block.
Figure 6:
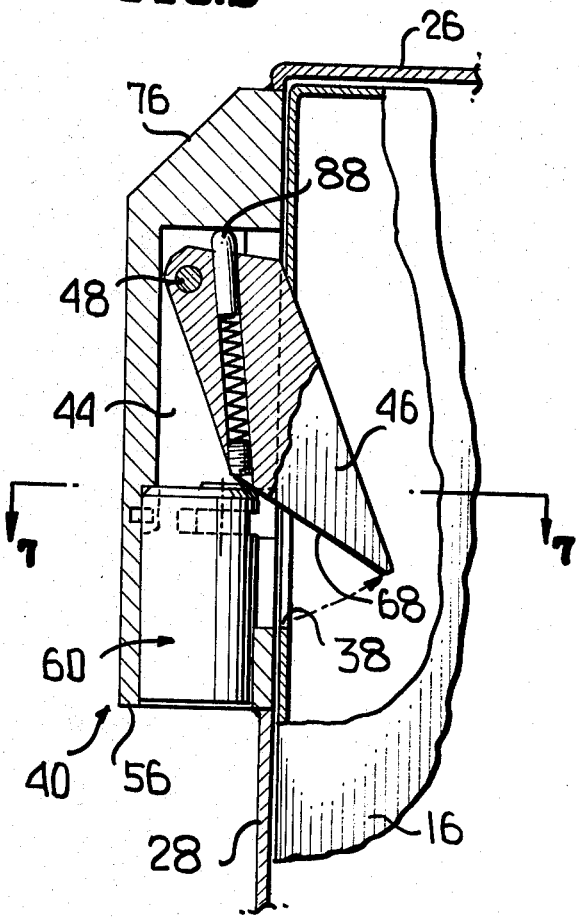
FIG. 6 is a fragmentary vertical sectional view similar to FIG. 2, but showing the lock in position pivoting the latch member into its locking position within the slot formed in the wall of the original housing for the coin mechanism and coin box.

When the lock 60 is inserted in the bore 58, the retainer element 64 is retracted and the barrel 62 may be easily slid into the bore into engagement with a cam surface 68 on the lower end of the latch member 46, forcing the latch member 46 to pivot in a counter clockwise direction, as shown in FIG. 2, to the latching position of FIG. 6. A key of the lock 60 is then rotated to move the retainer 64 into its lock retaining position, after which the key 66 is removed.

Rotation of the barrel 60 within the bore 58 may be prevented by means of a small pin 70 which is received in a vertical groove 72 formed in the upper part of the barrel 62.

At this time it is pointed out that the block 40 is machined to have a special retaining groove 74 for receiving the retaining element 64. However, this groove may be modified depending upon the type of retaining element carried by the lock 60.

It is preferred that the block 40 be formed of steel which has been hardened after machining so that the block 40 cannot be deformed sufficiently to either cause release of the latch member 46 or to jam the latch member 46 in its projected position. Also, in order to permit the block 40 to better resist hammer blows, the top thereof is primarily defined by a sloping top wall 76. In a like manner, the side walls are primarily defined by sloping surfaces 78. There is a narrow exposed front wall 80. However, hammer blows on this surface have little effect.

The block 40 is mounted on the inner side wall 28 of the protective housing 24 by forming an opening 82 in the wall 28 conforming to the shape and size of the block 40. The block 40 is then partially seated within the opening 82, as is clearly shown in the various figures, and then is secured in place by a welding 84 which extends entirely about the periphery of the block 40 and the opening 82.

In order that the release of the latch member 46 may be assured when the lock 60 is removed, the latch member 46 is provided with spring-loaded return means. These return means are in the form of a bore 86 through the latch member from the top to the bottom. In the upper end of the bore 86 there is positioned a pin 88 which engages the top wall of the slot 44 and is resiliently urged upwardly by means of a spring 90 disposed within the bore 86. The lower end of the bore 86 is closed by a removable set screw 92. It is preferred that the pin 88, the spring 90 and the screw 92 be installed after the latch member 46 has been installed. This is primarily due to the fact that hardening of the block 40 may be best accomplished after the pin 48 has been installed and the weld 54 placed within the bore 50.

Inasmuch as the latch member 46 is normally held in its retracted position by the spring loaded pin 88, the latch member 46 in no way interferes with the positioning of the protective housing 24. When the protective housing 24 is in place, the lock 60 is then installed, camming the latch member 46 through the slot 38, thereby locking the protective housing 24 to the housing 16 and preventing removal thereof. Inasmuch as the lock 60 faces towards the top wall 14 of the washing machine, it will be seen that it is not accessible for removal by drilling or the like. Further, any force which may be applied on the barrel 62 is one which would drive the barrel further into the block 40 and thereby more tightly setting the latch member 46.

At this time it is pointed out that a protective housing 24 having incorporated therein a latch mechanism 36 as illustrated and described herein was installed on a commercial washing machine and three men took turns striking the protective housing 24 with sledge hammers in an effort to remove the same and gain access to the coin box 20. It took two and one half hours for the three men to gain access.

Although only a preferred embodiment of the protective housing and latch mechanism have been specifically illustrated and described herein, it is to be understood that minor variations may be made therein without departing from the spirit and scope of the invention as defined by the appended claims.

I claim:

1. A vandal resistant latch mechanism for use in conjunction with coin boxes and the like, said latch mechanism comprising a block of hardened metal having a latching face, a slot opening through said latching face, a latch member, pivot means mounting said latch member for pivoting between an inoperative position within said slot and a latching position projecting from said latching face, said block having an end, a locking receiving opening extending through said end into said slot, and a removable barrel type key actuated lock releasably seated in said opening and forcing said latching member to said latching position, said latch mechanism being part of a protective housing particularly configurated to overlie and protect an ordinarily exposed housing used on a coin actuated mechanism and coin box of the type used in combination with washing machines, dryers and the like, and said protective housing has an opening therein for the passage of coin receiving mechanism.

2. A latch mechanism and protective housing combination according to claim 1 wherein said protective housing has sides and has a second opening in one side thereof, said block is partially seated in said protective housing second opening and is welded to said protective housing.

3. A latch mechanism and protective housing combination in accordance with claim 2 wherein said second opening is formed in that side of said protective housing configurated and positioned to overlie an adjacent machine top for preventing direct access to said lock.

4. A latch mechanism and protective housing combination according to claim 1 wherein said protective housing is telescoped over normally exposed parts of said housing for the coin actuated mechanism and coin box and substantially completely shielding the same, said coin mechanism and coin box having a conventional housing with a vertical slot in a vertical wall thereof, and said latch member being engaged in said vertical slot and locking said protective housing in place.

5. A latch mechanism and protective housing combination according to claim 4 wherein said block overlies a top wall of a machine of which said coin mechanism and said coin box are parts, and said block end opposes said machine top and prevents direct access to said lock.

* * * * *